US008038530B2

(12) United States Patent
Aird et al.

(10) Patent No.: US 8,038,530 B2
(45) Date of Patent: Oct. 18, 2011

(54) METHOD AND APPARATUS FOR FILTERING WAGERING GAME CONTENT

(75) Inventors: Kenneth Alan Aird, Chicago, IL (US); Mike Sirotin, Mundelein, IL (US); Matthew D. Volmerding, Chicago, IL (US); Timothy D. Wilson, Oak Park, IL (US)

(73) Assignee: WMS Gaming Inc., Waukegan, IL (US)

( * ) Notice: Subject to any disclaimer, the term of this patent is extended or adjusted under 35 U.S.C. 154(b) by 493 days.

(21) Appl. No.: 11/276,187

(22) Filed: Feb. 17, 2006

(65) Prior Publication Data

US 2006/0281542 A1 Dec. 14, 2006

Related U.S. Application Data

(60) Provisional application No. 60/657,114, filed on Feb. 28, 2005.

(51) Int. Cl.
*A63F 9/24* (2006.01)

(52) U.S. Cl. ..... 463/29; 463/16

(58) Field of Classification Search ..... 463/42, 463/16, 29

See application file for complete search history.

(56) References Cited

U.S. PATENT DOCUMENTS

| | | | | |
|---|---|---|---|---|
| 4,072,930 | A | | 2/1978 | Lucero |
| 4,405,829 | A | | 9/1983 | Rivest et al. |
| 4,607,844 | A | | 8/1986 | Fullerton |
| 4,727,544 | A | | 2/1988 | Brunner et al. |
| 4,765,579 | A | | 8/1988 | Robbins et al. |
| 5,155,768 | A | | 10/1992 | Matsuhara |
| 5,231,668 | A | | 7/1993 | Kravitz |
| 5,292,726 | A | | 3/1994 | Ashton et al. |
| 5,326,104 | A | | 7/1994 | Pease |
| 5,643,086 | A | * | 7/1997 | Alcorn et al. ..... 463/29 |
| 5,644,704 | A | | 7/1997 | Pease et al. |
| 5,668,945 | A | | 9/1997 | Ohba |
| 5,707,286 | A | | 1/1998 | Carlson |
| 5,737,418 | A | | 4/1998 | Saffari |
| 5,768,382 | A | | 6/1998 | Schneier et al. |
| 5,871,398 | A | | 2/1999 | Schneier |
| 5,970,143 | A | | 10/1999 | Schneier |
| 5,971,851 | A | | 10/1999 | Pascal |
| 6,071,190 | A | | 6/2000 | Weiss et al. |
| 6,099,408 | A | | 8/2000 | Schneier et al. |
| 6,106,396 | A | | 8/2000 | Alcorn et al. |
| 6,149,522 | A | | 11/2000 | Alcorn et al. |
| 6,203,427 | B1 | | 3/2001 | Walker et al. |
| 6,247,004 | B1 | | 6/2001 | Moukheibir |

(Continued)

FOREIGN PATENT DOCUMENTS

| | | |
|---|---|---|
| EP | 1703478 A2 | 9/2006 |

(Continued)

*Primary Examiner* — Omkar Deodhar

(74) *Attorney, Agent, or Firm* — Schwegman, Lundberg & Woessner, P.A.

(57) ABSTRACT

Methods and apparatus for filtering wagering game content are described herein. In one embodiment, the wagering game system includes a wagering game content filter to receive wagering game content over a communications network and to authenticate the wagering game content. The wagering game system can also include a memory unit to receive the wagering game content after the wagering game content filter has authenticated the wagering game content. The wagering game system can also include a processor to fetch the wagering game content from the memory unit and to conduct a wagering game based on the wagering game content.

33 Claims, 9 Drawing Sheets

U.S. PATENT DOCUMENTS

| | | | | |
|---|---|---|---|---|
| 6,247,005 | B1 | 6/2001 | Edwards et al. | |
| 6,264,557 | B1 | 7/2001 | Schneier et al. | |
| 6,364,769 | B1 | 4/2002 | Weiss | |
| 6,402,614 | B1 | 6/2002 | Schneier | |
| 6,409,602 | B1 | 6/2002 | Wiltshire | |
| 6,450,885 | B2 | 9/2002 | Schneier et al. | |
| 6,487,657 | B1 * | 11/2002 | Brockmann | 713/154 |
| 6,488,581 | B1 | 12/2002 | Stockdale | |
| 6,527,638 | B1 | 3/2003 | Walker et al. | |
| 6,565,443 | B1 | 5/2003 | Johnson et al. | |
| 6,595,856 | B1 | 7/2003 | Ginsburg et al. | |
| 6,607,439 | B2 | 8/2003 | Schneier | |
| 6,620,047 | B1 | 9/2003 | Alcorn et al. | |
| 6,629,184 | B1 | 9/2003 | Berg | |
| 6,645,077 | B2 | 11/2003 | Rowe | |
| 6,675,152 | B1 | 1/2004 | Prasad | |
| 6,685,567 | B2 | 2/2004 | Cockerille et al. | |
| 6,722,986 | B1 | 4/2004 | Lyons et al. | |
| 6,823,419 | B2 | 11/2004 | Berg | |
| 6,875,109 | B2 | 4/2005 | Stockdale | |
| 6,918,831 | B2 | 7/2005 | Nguyen | |
| 6,926,605 | B2 | 8/2005 | Nguyen | |
| 6,935,952 | B2 | 8/2005 | Walker | |
| 6,942,570 | B2 | 9/2005 | Schneier | |
| 6,962,530 | B2 | 11/2005 | Jackson | |
| 6,964,611 | B2 | 11/2005 | Packes, Jr. | |
| 7,008,318 | B2 | 3/2006 | Schneier | |
| 7,043,641 | B1 * | 5/2006 | Martinek et al. | 713/187 |
| 7,062,470 | B2 | 6/2006 | Prasad | |
| 7,063,615 | B2 | 6/2006 | Alcorn | |
| RE39,368 | E | 10/2006 | Alcorn | |
| RE39,369 | E | 10/2006 | Alcorn | |
| RE39,370 | E | 10/2006 | Alcorn | |
| 7,116,782 | B2 | 10/2006 | Jackson | |
| 7,125,017 | B2 | 10/2006 | LaPorte | |
| RE39,400 | E | 11/2006 | Alcorn | |
| RE39,401 | E | 11/2006 | Alcorn | |
| 7,137,893 | B2 | 11/2006 | Canterbury | |
| 7,162,036 | B2 | 1/2007 | Rowe | |
| 7,177,428 | B2 | 2/2007 | Gordon | |
| 7,179,170 | B2 | 2/2007 | Martinek | |
| 7,201,662 | B2 | 4/2007 | LeMay et al. | |
| 2002/0049909 | A1 * | 4/2002 | Jackson et al. | 713/188 |
| 2002/0187828 | A1 | 12/2002 | Benbrahim | |
| 2003/0008704 | A1 | 1/2003 | Gauselmann | |
| 2003/0026942 | A1 | 2/2003 | Hejna et al. | |
| 2003/0028779 | A1 | 2/2003 | Rowe | |
| 2003/0130032 | A1 * | 7/2003 | Martinek et al. | 463/29 |
| 2003/0171149 | A1 * | 9/2003 | Rothschild | 463/42 |
| 2003/0195033 | A1 | 10/2003 | Gazdic et al. | |
| 2003/0203565 | A1 | 10/2003 | McQueen et al. | |
| 2004/0002381 | A1 | 1/2004 | Alcorn | |
| 2004/0038740 | A1 | 2/2004 | Muir | |
| 2004/0043820 | A1 | 3/2004 | Schlottmann | |
| 2004/0198494 | A1 | 10/2004 | Nguyen et al. | |
| 2004/0199234 | A1 | 10/2004 | Rodriguez | |
| 2004/0243848 | A1 | 12/2004 | Blackburn et al. | |
| 2004/0248646 | A1 | 12/2004 | Canterbury | |
| 2004/0259633 | A1 | 12/2004 | Gentles et al. | |
| 2004/0259643 | A1 | 12/2004 | Gentles | |
| 2005/0009599 | A1 | 1/2005 | Ryan | |
| 2005/0014559 | A1 | 1/2005 | Mattice et al. | |
| 2005/0020356 | A1 | 1/2005 | Cannon | |
| 2005/0143171 | A1 | 6/2005 | Loose | |
| 2005/0287794 | A1 | 12/2005 | Fishburn | |
| 2006/0035703 | A1 | 2/2006 | Nguyen | |
| 2006/0035708 | A1 | 2/2006 | Nguyen | |
| 2006/0211490 | A1 | 9/2006 | Falvey | |
| 2006/0211491 | A1 | 9/2006 | Falvey | |
| 2006/0240888 | A1 | 10/2006 | Tanimura | |
| 2006/0247004 | A1 | 11/2006 | Tanimura | |
| 2006/0247005 | A1 | 11/2006 | Tanimura | |
| 2006/0247020 | A1 | 11/2006 | Fujimori | |
| 2007/0021194 | A1 | 1/2007 | Aida | |
| 2007/0021195 | A1 | 1/2007 | Campbell et al. | |
| 2007/0026942 | A1 | 2/2007 | Kinsley et al. | |

FOREIGN PATENT DOCUMENTS

| | | | |
|---|---|---|---|
| GB | 2121569 | A | 12/1983 |
| JP | 02119427 | | 5/1990 |
| WO | WO-99/65579 | A1 | 12/1999 |
| WO | WO-2005/029272 | A2 | 3/2005 |

* cited by examiner

METHOD AND APPARATUS FOR FILTERING WAGERING GAME CONTENT

RELATED APPLICATION

This application claims priority under 35 U.S.C. 119(e) from U.S. Provisional Application Ser. No. 60/657,114 filed Feb. 28, 2005, which application is incorporated herein by reference.

FIELD

This invention relates generally to the field of wagering game machines and more particularly to the field of data transmissions in a wagering game environment.

LIMITED COPYRIGHT WAIVER

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever. Copyright 2006, WMS Gaming, Inc.

DESCRIPTION OF RELATED ART

Wagering game makers continually provide new and entertaining games. One conventional way of increasing entertainment value associated with casino-style wagering games (e.g., video slots, video poker, video black jack, and the like) includes offering a base game and a variety of bonus events. However, players often become disinterested in repetitive base games and bonus events. In order to maintain player interest, wagering game machine makers frequently update game themes, game settings, and bonus events.

In certain gaming jurisdictions, updating wagering game machines can be a very expensive because gaming regulators must approve changes to wagering game machine logic (e.g. software or hardware). For example, gaming regulators must approve software modifications that implement new game settings and bonus events. Wagering game makers typically comply with these stringent requirements by submitting complete copies of wagering game software, including both modified and unmodified code segments. If the wagering game software meets all applicable gaming regulations, gaming regulators typically approve the software for installation in publicly used wagering game machines. Gaming regulators often require game makers to digitally sign approved software using procedures approved by the gaming regulators.

Gaming regulators often require wagering game makers to take several additional measures for ensuring that wagering game logic is not improperly modified or tampered-with. For example, some jurisdictions require that wagering game machine logic be securely locked in a tamper-resistant cabinet. Additionally, some jurisdictions prohibit loading unapproved software into a wagering game machine's random access memory. To enforce this regulation, gaming regulators often inspect all installed software for digital signatures, which indicate the software is authentic and has been approved by regulators. In some jurisdictions, gaming regulators prohibit wagering game machines from receiving any data over communications networks. Such a prohibition may arise from concerns that poor network security could result in unapproved or maliciously modified software being loaded into wagering game machines. Because regulators prohibit wagering game machines from receiving data over networks, wagering game makers have been limited to manually disseminating wagering game updates.

As a result, there is a need for an easily approved device that enables secure dissemination of wagering game updates over communications networks.

BRIEF DESCRIPTION OF THE FIGURES

The present invention is illustrated by way of example and not limitation in the Figures of the accompanying drawings in which:

FIG, 1 is a dataflow diagram illustrating dataflow and operations associated with a wagering game content filter, according to example embodiments of the invention;

Figure 1:
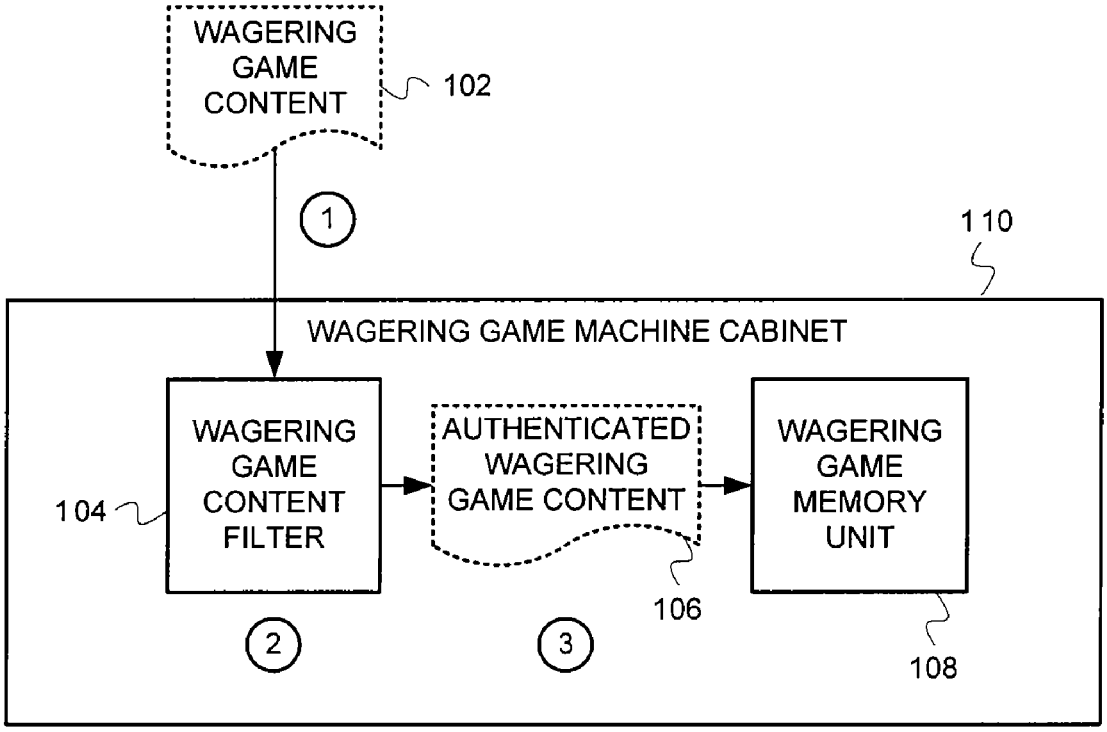

FIG, 2 is a block diagram illustrating a system for filtering wagering game content, according to example embodiments of the invention;

FIG, 3 is a block diagram illustrating another system for filtering wagering game content, according to example embodiments of the invention;

FIG, 4 is a block diagram illustrating a wagering game content filter, according to example embodiments of the invention;

FIG, 5 is a flow diagram illustrating operations for filtering wagering game content received over communications network, according to example embodiments of the invention;

FIG, 6 is a flow diagram illustrating operations for receiving wagering game content from a wagering game content filter, according to example embodiments of the invention;

FIG, 7 is a flow diagram illustrating operations for establishing a trust relationship between a wagering game content filter and a filter authentication unit, according to example embodiments of the invention;

FIG, 8 is a flow diagram illustrating operations for establishing a trust relationship between a filter authentication unit and a wagering game content filter, according to example embodiments of the invention; and FIG, 9 is a perspective view of a wagering game machine, according to example embodiments of the invention.

DESCRIPTION OF THE EMBODIMENTS

Methods and apparatus for filtering wagering game content are described herein. This description of the embodiments is divided into five sections. The first section provides an introduction, while the second section describes an example system architecture. The third section describes example operations and the fourth section describes a gaming machine. The fifth section provides some general comments.

Introduction

This section introduces a wagering game content filter for filtering gaming content received over a communications network. The discussion below will describe data transmissions and operations performed by embodiments of a wagering game content filter.

FIG, 1 is a dataflow diagram illustrating dataflow and operations associated with a wagering game content filter, according to example embodiments of the invention. As shown in FIG, 1, a wagering game machine cabinet 110 includes a wagering game content filter 104 and a wagering game machine memory unit 108. Although the wagering game content filter 104 is shown inside the wagering game machine cabinet 110, in one embodiment, the filter 104 is not part of the wagering game machine. Instead, the wagering game content filter 104 can be a device distinct from the wagering game machine.

The dataflow of FIG, 1 is divided into three stages. At stage one, the wagering game content filter 104 receives wagering game content 102 over a communications network (not shown). At stage two, the wagering game content filter 104 authenticates (i.e. determines that the content is unmodified and from a trusted source) the wagering game content. At stage three, the wagering game content filter 104 transmits authenticated wagering game content 106 to a wagering game machine memory unit 108. If the wagering game content filter 104 cannot authenticate wagering game content, it will not pass unauthenticated wagering game content to the wagering game machine memory unit 108.

The wagering game content filter 104 can be designed for relatively easy regulatory inspection and approval, as it can be far less complex than wagering game machine hardware and software. Because the wagering game content filter 104 can be easily inspected and approved, gaming regulators may allow wagering game machines to receive gaming content over communications networks, so long as the content is filtered by an approved wagering game content filter.

System Architecture

This section describes an example system architecture for filtering wagering game content. Operations of the system components will be described in the next section.

FIG, 2 is a block diagram illustrating a system for filtering wagering game content, according to example embodiments of the invention. In FIG, 2, the system 200 includes a wagering game content server 218, network 220, and wagering game machine 224. The wagering game content server 218 can store wagering game content, such as program code, game settings, and game themes. The wagering game content can include audio content (e.g., MP3 files or other encoded audio files) and video content (e.g., bitmapped images, prerecorded or streaming video images, animated images, etc.). In one embodiment, the wagering game server 218 stores wagering game content that has been digitally signed by a wagering game content provider. The content provider can digitally sign the content using a securely held private key and then upload the content to the server 218. In one embodiment, a wagering game content filter or other device can authenticate the wagering game content using the content provider's public key.

The network 220 can be any communications network, such as a local area network or wide-area network. The network 220 can transmit wagering game content using any suitable communication protocols, including Ethernet, 802.11b, 802.11g, etc.

The wagering game machine 224 includes a cabinet 222 and wagering game machine components 226. The wagering game machine components 226 include a processor 212 connected to an audio unit 208, display unit 214, memory unit 204, input units 202, and persistent storage unit 210. The processor 212 can conduct a wagering game by executing program code and utilizing wagering game content. The program code and wagering game content can be stored in the memory unit 204 and the persistent storage unit 210. The processor can present audio content on the audio unit 208 and video content on the display unit 214. The processor 212 can receive player input through input units 202.

The cabinet 222 also includes a wagering game content filter 216. The wagering game content filter 216 is connected to the memory unit 204 and the processor 212. In one embodiment, the wagering game content filter 216 is not considered part of the wagering game machine 222 because the filter's primary functionality is not related to conducting a wagering game. Instead, the wagering game content filter 216 receives wagering game content over the communications network 220 and filters trusted content (i.e., content that has been approved by gaming regulators and that is from a known and trusted source) from non-trusted content. The wagering game content filter 216 forwards trusted wagering game content to the processor 212 and/or the memory unit 204, while prohibiting non-trusted content from entering the memory unit 204.

Although the components of the system 200 are connected as show in FIG, 2, they can be connected in any suitable fashion. For example, each of the wagering game machine components 226 can be connected to all other wagering game components.

Any component of system 200 can include machine-readable media including instructions for performing operations described herein. Machine-readable media includes any mechanism that provides (i.e., stores and/or transmits) information in a form readable by a machine (e.g., a computer). For example, a machine-readable medium includes read only memory (ROM), random access memory (RAM), magnetic disk storage media, optical storage media, flash memory devices, electrical, optical, acoustical or other forms of propagated signals (e.g., carrier waves, infrared signals, digital signals, etc.). According to embodiments of the invention, the components of the system 100 can include other various types of logic (e.g., digital logic) for processing game scenes on a gaming device, as described herein.

Operations of the wagering game filter 216 and wagering game components 226 will be described in greater detail in the next section. FIG, 3 will described another embodiment of a system for filtering wagering game content.

FIG, 3 is a block diagram illustrating another system for filtering wagering game content, according to example embodiments of the invention. In FIG, 3, the system 300 is very similar to the system 200 of FIG, 2. In the system 300, the wagering game content filter 216 is positioned outside the cabinet 222. The wagering game content filter 216 is connected to a filter authentication unit 302, which is disposed inside the cabinet 222. The filter authentication unit 302 is connected to the memory unit 204 and the processor 212.

The filter authentication unit 302 can establish a trust relationship with the wagering game content filter 216 (i.e., the authentication unit 302 can verify that the filter 216 is an authentic filter from which it can receive trusted content) without loading any unapproved/non-trusted content into the memory unit 204. In one embodiment, the wagering game content filter 216 can provide wagering game content to several wagering game machines. In such embodiment, several filter authentication units will establish trusted relationships with the wagering game content filter 216. FIG, 4 will described components of a wagering game content filter in greater detail.

In one embodiment, the filter authentication unit 302 and the wagering game content filter 216 authenticate each other using a three-way handshake (see the discussion of FIGS. 7 and 8 below), which calls for each unit to securely maintain a private key. The filter authentication unit 302 and wagering game content filter 216 can each include a hermetically sealed device for securing the private key. If the seal is broken, the private key is destroyed. The private key device can be permanently attached to each unit in a way that would break the seal if the device were tampered-with. One such private key device is the Java-Powered Cryptographic iButton, available from Maxim Integrated Products, Inc. of Sunnyvale, Calif.

In one embodiment, the transmission medium between the wagering game content filter 216 and the cabinet 222 is physically secure. For example, a wire running between filter 216 and the cabinet 222 runs through a physically secure and inaccessible container. However, in another embodiment, the wagering game content filter 216 uses encryption to secure its communications with the wagering game machine 224.

FIG, 4 is a block diagram illustrating a wagering game content filter, according to example embodiments of the invention. As shown in FIG, 4, a wagering game content filter 400 includes an authentication unit 402, communications processing unit 404, and storage unit 406. The authentication unit 402 can authenticate wagering game content and establish trusted relationships with filter authentication units. (See block 306 of FIG, 3.) The communications processing unit 404 receives and transmits wagering game content over communications networks, while the storage unit 406 stores the wagering game content.

In one embodiment, the storage unit 406 is inaccessible to any of the wagering game components 226. Because the storage unit 406 is inaccessible, the wagering game components 226 cannot load unapproved or untrusted software into the wagering game machine's memory unit 204. In one embodiment, the storage unit 406 is configurable to be accessible (e.g., within the address space of the wagering game components) or inaccessible by the wagering game components 226.

Figure 2:
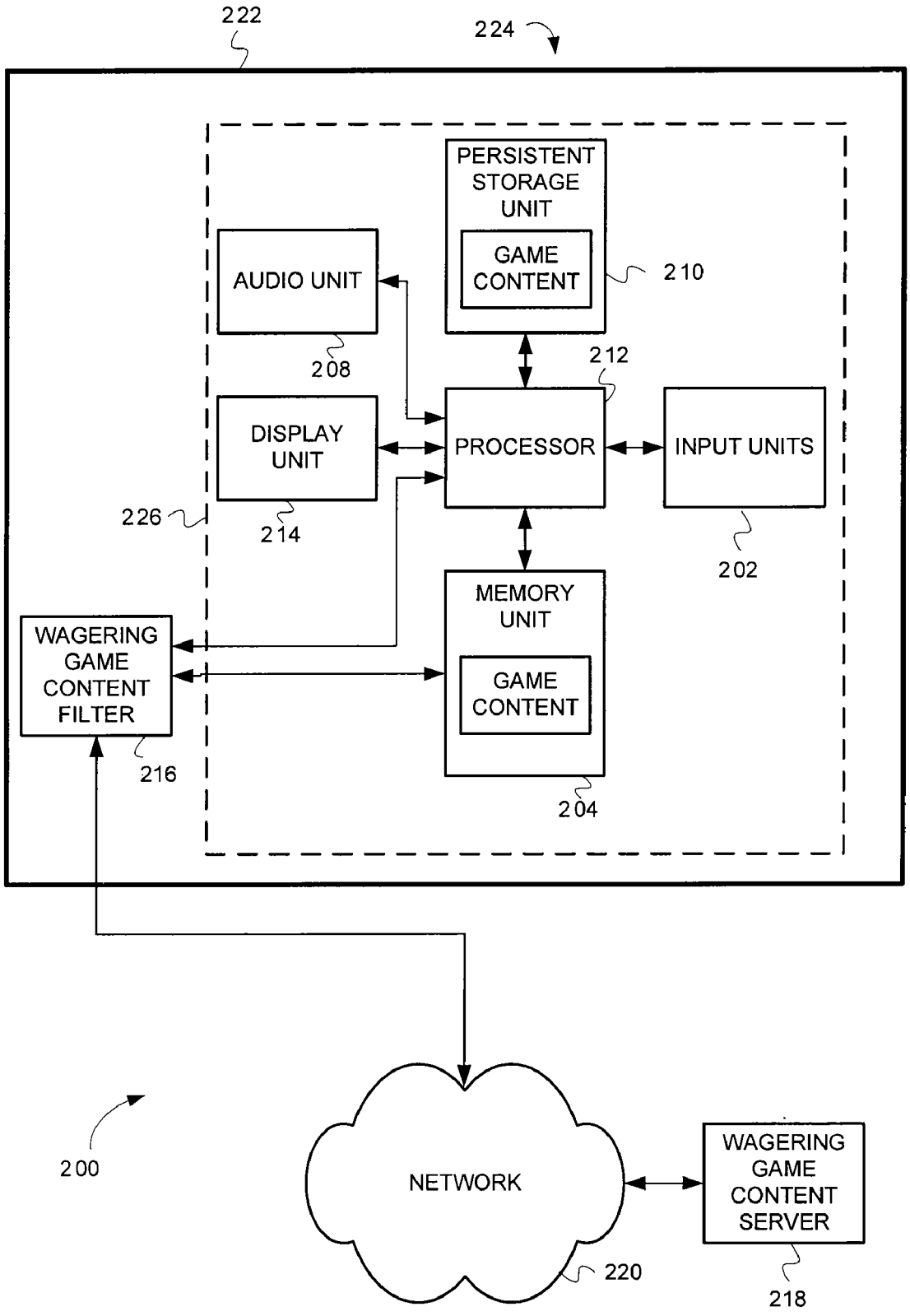
Figure 3:
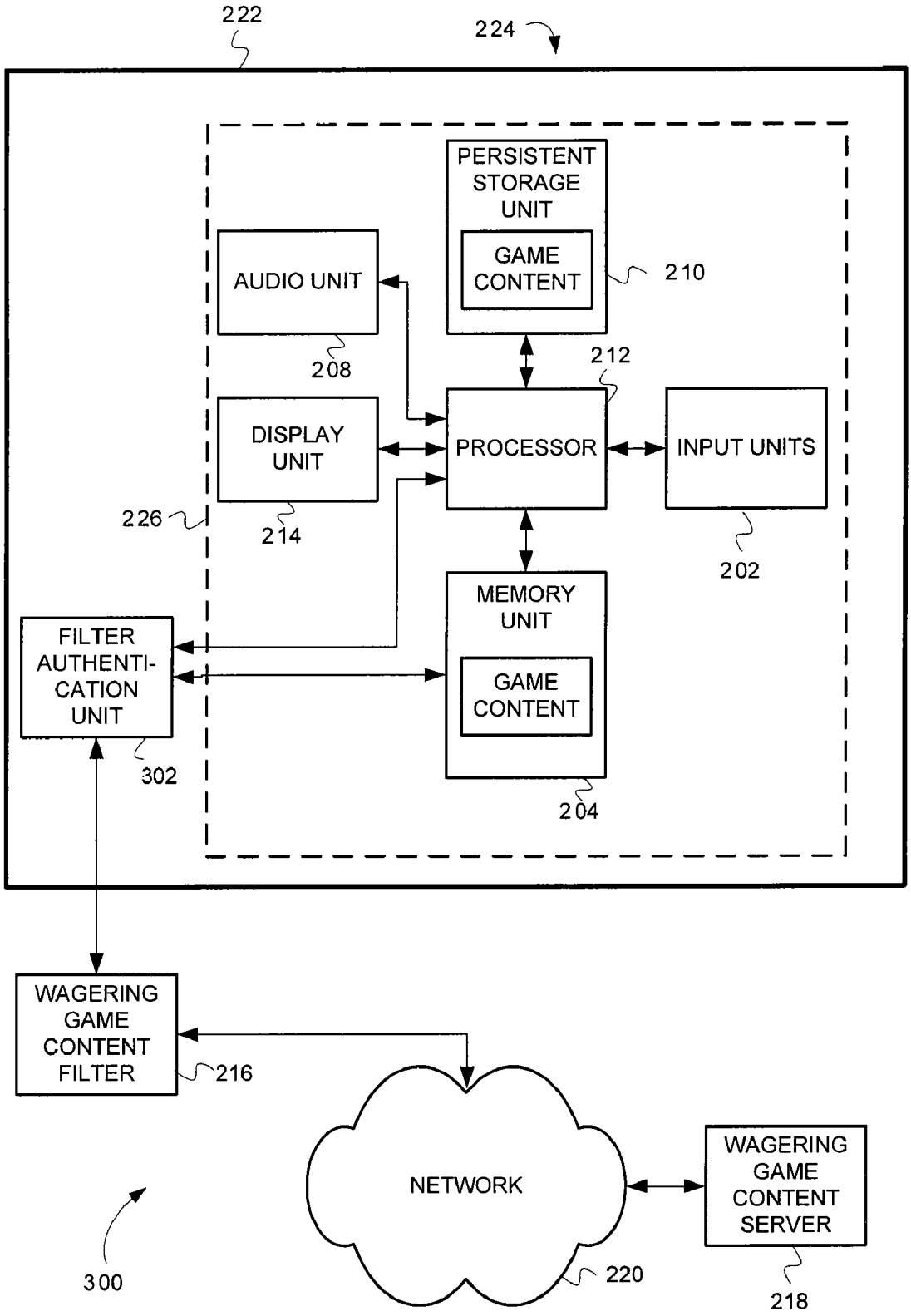

In FIG, 4, the units are fully connected (i.e., each unit is connected to the other units). However, according to other embodiments, the units can be connected in any suitable fashion. The next section will describe operations which can be performed by the components of the systems of FIGS. 2 and 3.

System Operations

This section describes operations performed by embodiments of the invention. In certain embodiments, the operations are performed by instructions residing on machine-readable media (e.g., software), while in other embodiments, the methods are performed by hardware or other logic (e.g., digital logic).

Figure 7:
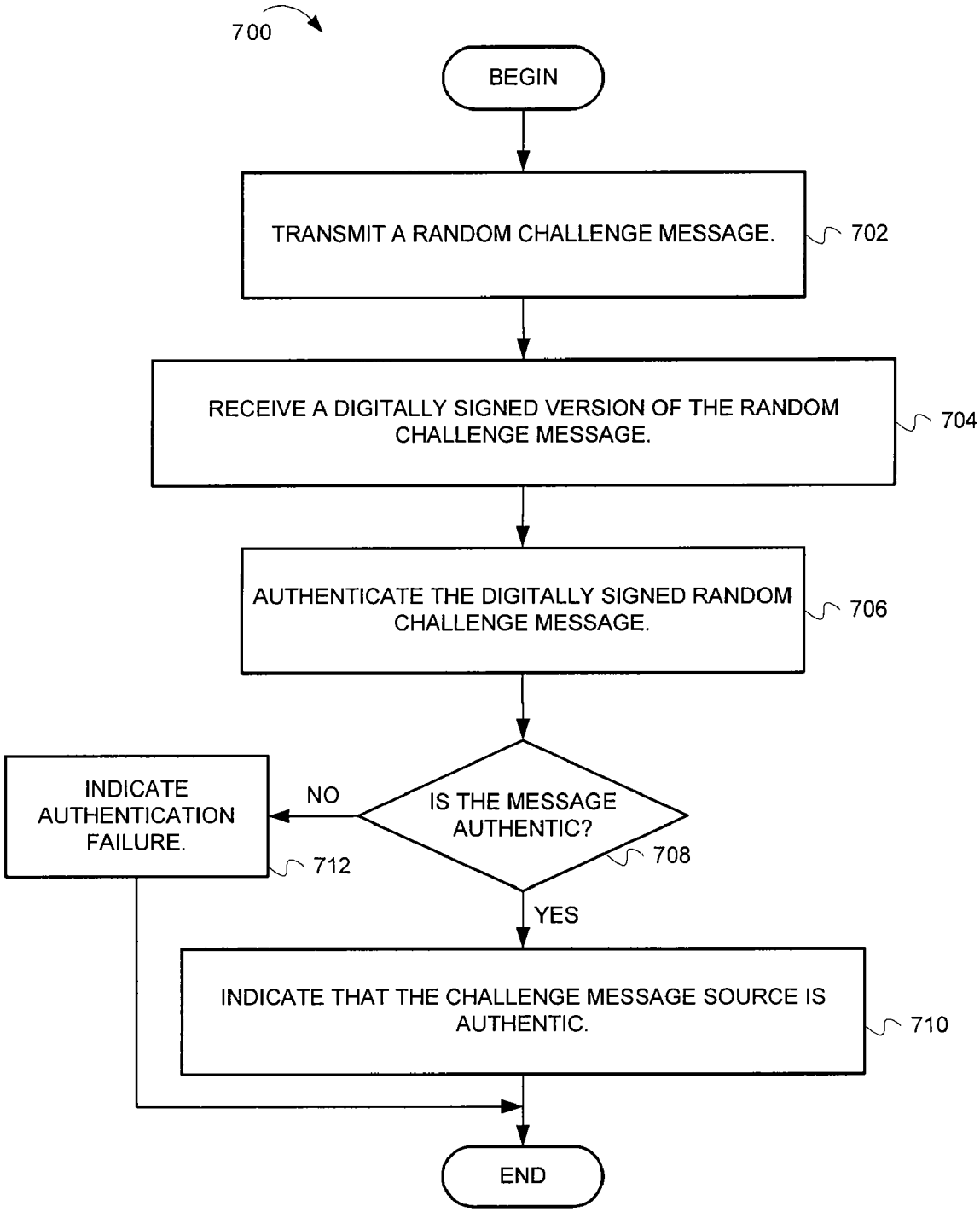
Figure 8:
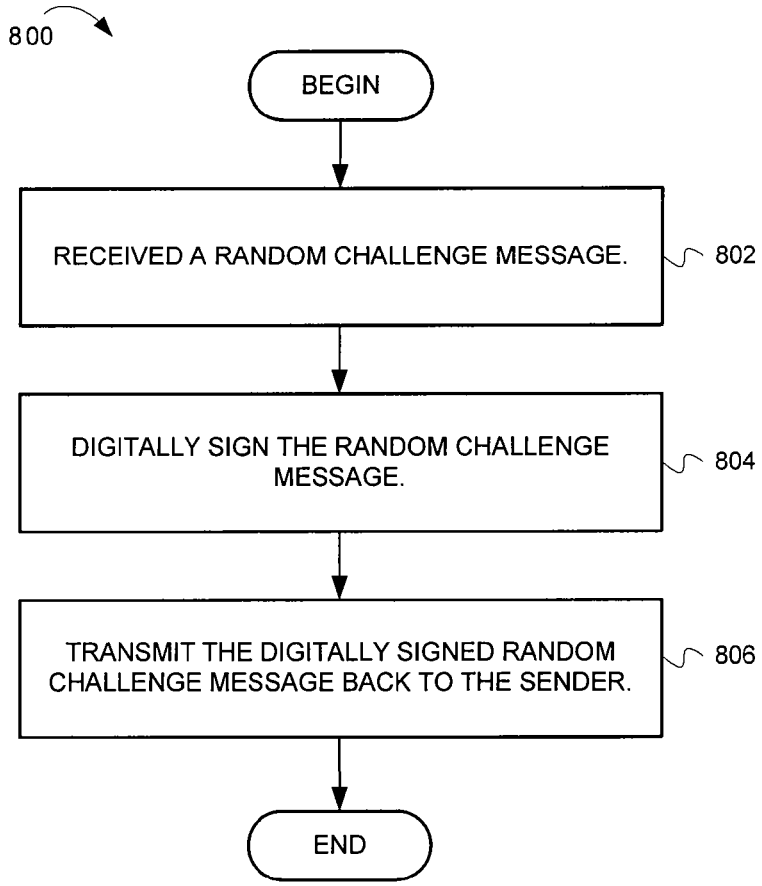
Figure 9:
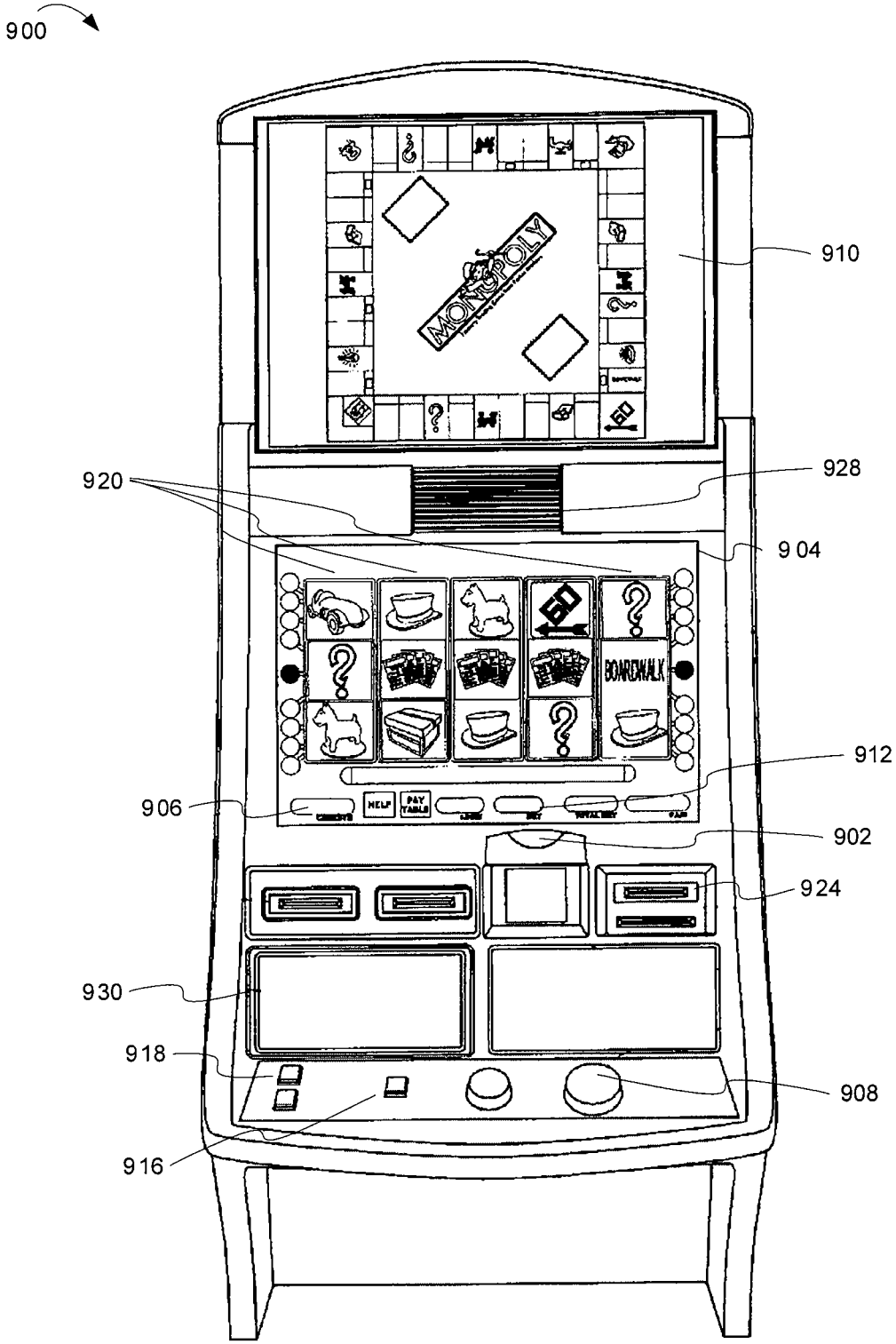

In this section, FIGS. 5-8 will be discussed. In particular, FIGS. 5 and 6 describe operations for filtering content received over a communications network. FIGS. 7 and 8 describe operations for establishing a trust relationship between a filter authentication unit and a wagering game content filter. This discussion will proceed with a discussion of FIG, 5.

Figure 4:
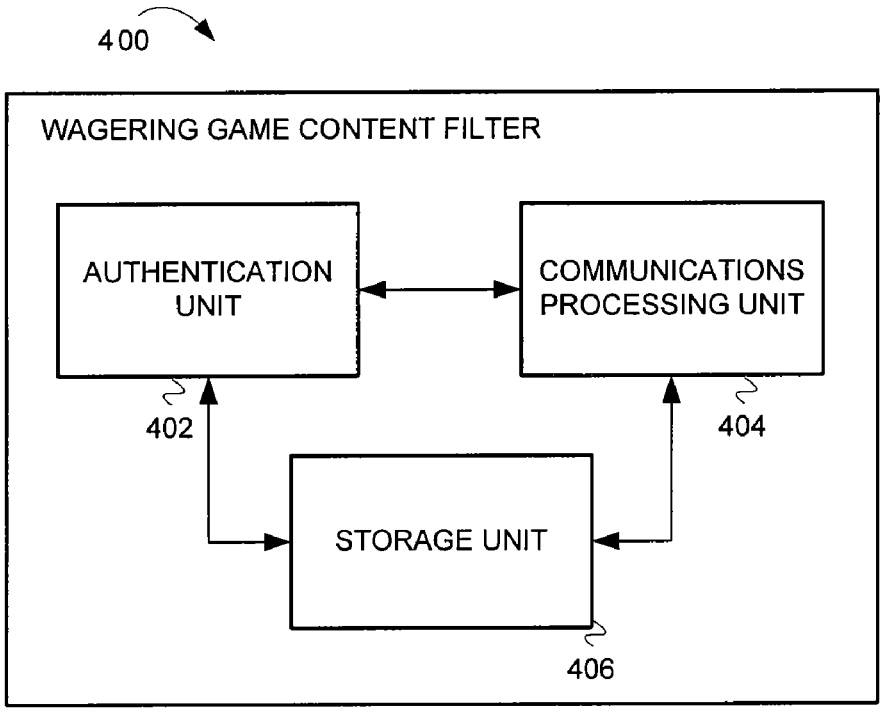
Figure 5:
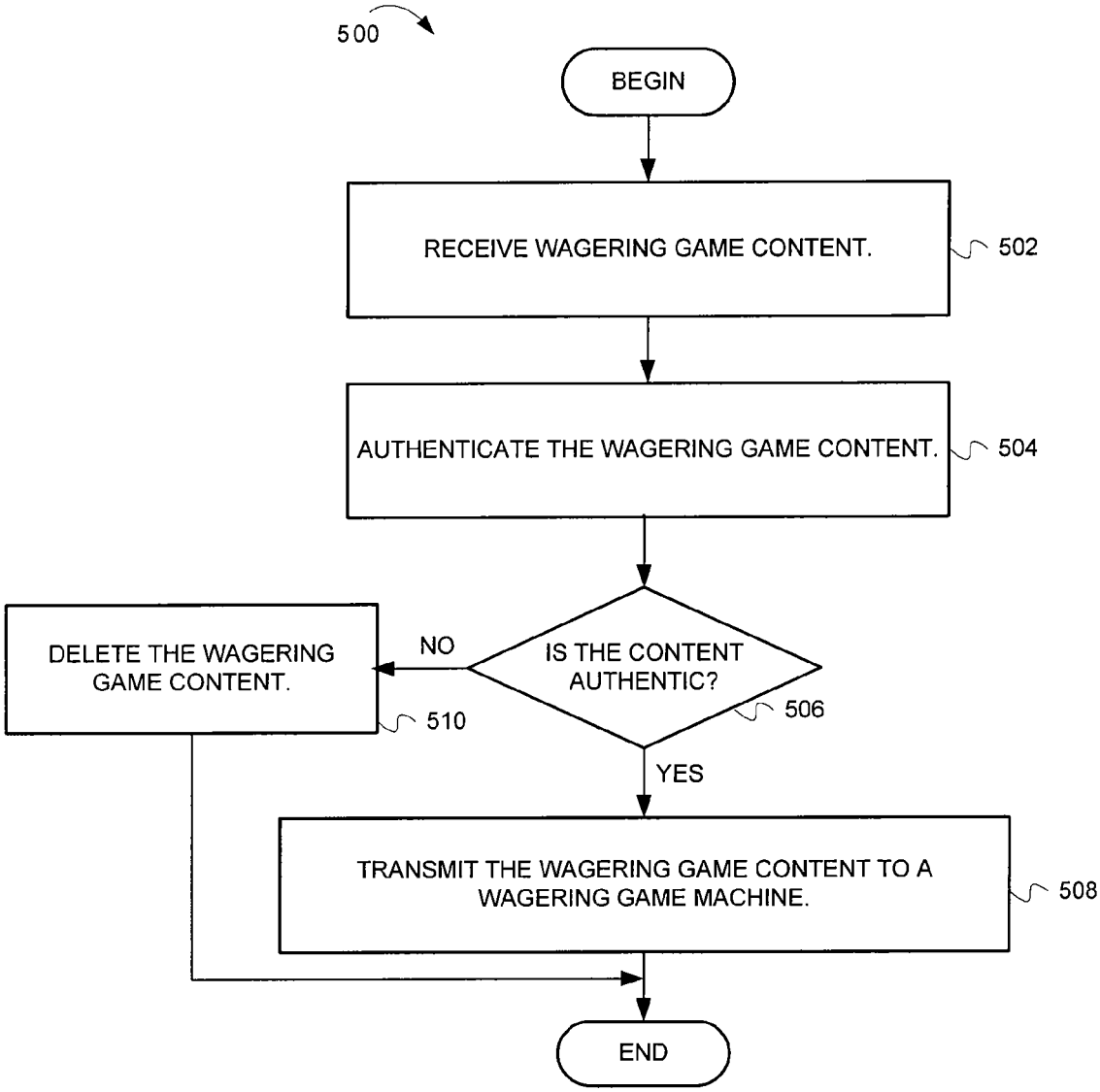
Figure 6:
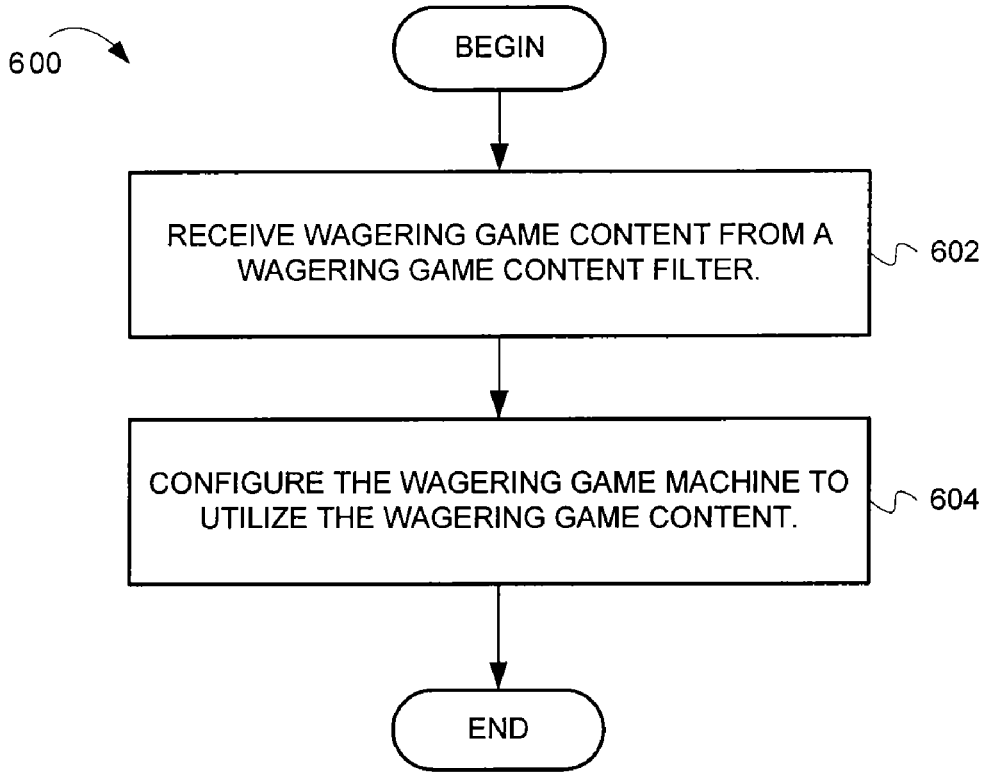

FIG, 5 is a flow diagram illustrating operations for filtering wagering game content received over a communications network, according to example embodiments of the invention. The flow diagram 500 will be described with reference to the example embodiments shown in FIGS. 2 and 4. The flow diagram 500 commences at block 502.

At block 502, the wagering game content filter 216 receives wagering game content from the wagering game content server 218 over the communications network 220. The wagering game content filter 216 can store the wagering game content in its storage unit 406. In one embodiment, the wagering game content has been digitally signed according to a public/private key methodology, where the content provider signs the content with a secure private key. The flow continues at block 504.

At block 504, the wagering game content filter 206 authenticates the wagering game content. In one embodiment, the filter's authentication unit 402 determines whether the wagering game content is from a trusted source and whether the content has been modified.

In an embodiment where the content provider digitally signed the wagering game content using a secure private key, the authentication unit 402 can authenticate the wagering game content using a public key available from the wagering game content provider.

In one embodiment, the authentication unit 402 authenticates the wagering game content using message authentication codes. In such an embodiment, the wagering game content includes a message authentication code (MAC) created with a secure private key. Upon receiving the wagering game content, the authentication unit 402 can use a public key to determine a MAC for the wagering game content. The authentication unit 402 can then compare it's MAC to the MAC included with the wagering game content. If the MACs match, the wagering game content is from a trusted source and has not been modified. Otherwise, the content has been modified and/or is not from a trusted source.

In another embodiment, the authentication unit 402 can use other suitable cryptographic techniques for authenticating the wagering game content. The flow continues at block 506.

At block 506, if the wagering game content is authentic, the flow continues at block 508. Otherwise, the flow continues at block 510.

At block 508, the communications processing unit 404 transmits the wagering game content to the wagering game machine's memory unit 204. In one embodiment, the communications processing unit 404 can transmit the wagering game content to the processor 212 or the persistent storage unit 210. From block 508, the flow ends.

At block 510, the authentication unit 402 deletes the wagering game content from the storage unit 406. From block 510, the flow ends.

While FIG, 5 describes operations for filtering and authenticating wagering game content, FIG, 6 describes operations for receiving authenticated wagering game content in a wagering game machine.

FIG, 6 is a flow diagram illustrating operations for receiving wagering game content from a wagering game content filter, according to example embodiments of the invention. The flow diagram 600 will be described with reference to the example embodiments shown in FIGS. 2 and 4. The flow diagram 600 commences at block 602.

At block 602, the wagering game machine's memory unit 204 receives wagering game content from the wagering game content filter 216. The flow continues at block 604.

At block 604, the wagering game machine's processor 212 configures the wagering game machine to utilize the wagering game content. For example, the processor 212 integrates program code, audio content, and video content contained within the wagering game content into existing wagering game logic. In one embodiment, after the wagering game content is integrated into the existing wagering game logic, the wagering game machine is capable of presenting updated game settings, bonus events, and/or wagering games. From block 604, the flow ends.

The discussion will now turn to operations performed by systems that include filter authentication units (see FIG, 3). In one embodiment, a plurality of wagering game machines can receive trusted wagering game content from a single wagering game content filter. In order to maintain system security, before accepting wagering game content from a wagering game content filter, each wagering game machine establishes a trust relationship with the wagering game content filter. In one embodiment, each wagering game machine uses a filter authentication unit to establishes this trust relationship. Using a single wagering game content filter to deliver content a plurality of wagering game machines can reduce system production and service costs. This description will proceed with a discussion of FIG, 7.

FIG, 7 is a flow diagram illustrating operations for establishing a trust relationship between a wagering game content filter and a filter authentication unit, according to example embodiments of the invention. In one embodiment, the wagering game content filter can perform the following operations with a plurality of filter authentication units. The flow diagram 700 will be described with reference to the example system shown in FIG, 3. The flow diagram 700 commences at block 702.

At block 702, the wagering game content filter 216 transmits a random challenge message to the filter authentication unit 302. The flow continues at block 704.

At block 704, the wagering game content filter 216 receives a digitally signed version of the random challenge message from the filter authentication unit 302. In one embodiment, the filter authentication unit 302 digitally signed the acknowledgment message using a secure secret key. The flow continues at block 706.

At block 706, the wagering game content filter 216 authenticates the digitally signed random challenge message. In one embodiment, the wagering game content filter 216 uses a public key associated with the filter authentication unit 302 to determine the validity of the message's digital signature. The flow continues at block 708.

At block 708, the wagering game content filter 216 determines whether the digitally signed random challenge message is authentic. If the acknowledgement message is authentic, the flow continues at block 710. Otherwise, the flow continues at block 712.

At block 710, the wagering game content filter 216 indicates that the challenge message source (i.e., wagering game authentication unit 302) is authentic. From block 710, the flow ends.

At block 712, the wagering game content filter 216 indicates an authentication failure. In one embodiment, the wagering game content filter 216 transmits a message to gaming operators indicating the failed authentication. From block 712, the flow ends.

FIG, 8 is a flow diagram illustrating operations for establishing a trust relationship between a filter authentication unit and a wagering game content filter, according to example embodiments of the invention. The flow diagram 800 will be described with reference to the example system shown in FIG, 3. The flow diagram 800 commences at block 802.

At block 802, the filter authentication unit 302 receives a random challenge message from the wagering game content filter 216 The flow continues at block 804.

At block 804, the filter authentication unit 302 digitally signs the random challenge message using a securely held private key. The flow continues at block 806.

At block 806, the filter authentication unit 302 transmits the digitally signed random challenge message back to the wagering game content filter 216. From block 806, the flow ends.

In one embodiment, the authentication is not complete until the filter authentication unit 302 performs the operations shown in FIG, 7 and the wagering game content filter 216 performs the operations shown in FIG, 8. Thus, each device performs the operations of both FIGS. 7 and 8. After the trust relationship is established between the filter authentication unit 308 and the wagering game content filter 216, the filter authentication unit 308 can forward wagering game content to a wagering game machine.

Wagering Game Machine

This section describes a wagering game machine used in conjunction with embodiments of the invention.

FIG, 9 is a perspective view of a wagering game machine, according to example embodiments of the invention. As shown in FIG, 9, the wagering game machine 900 can be a computerized slot machine having the controls, displays, and features of a conventional slot machine.

The wagering game machine 900 can be operated while players are standing or seated. Additionally, the wagering game machine 900 is preferably mounted on a stand (not shown). However, it should be appreciated that the wagering game machine 900 can be constructed as a pub-style tabletop game (not shown), which a player can operate while sitting. Furthermore, the wagering game machine 900 can be constructed with varying cabinet and display designs. The wagering game machine 900 can incorporate any primary game such as slots, poker, or keno, and additional bonus round games. The symbols and indicia used on and in the wagering game machine 900 can take mechanical, electrical, or video form.

As illustrated in FIG, 9, the wagering game machine 900 includes a coin slot 902 and bill acceptor 924. Players can place coins in the coin slot 902 and paper money or ticket vouchers in the bill acceptor 924. Other devices can be used for accepting payment. For example, credit/debit card readers/validators can be used for accepting payment. Additionally, the wagering game machine 900 can perform electronic funds transfers and financial transfers to procure monies from financial accounts. When a player inserts money in the wagering game machine 900, a number of credits corresponding to the amount deposited are shown in a credit display 906. After depositing the appropriate amount of money, a player can begin playing the game by pushing play button 908. The play button 908 can be any play activator used for starting a wagering game or sequence of events in the wagering game machine 900.

As shown in FIG, 9, the wagering game machine 900 also includes a bet display 912 and a "bet one" button 916. The player places a bet by pushing the bet one button 916. The player can increase the bet by one credit each time the player pushes the bet one button 916. When the player pushes the bet one button 916, the number of credits shown in the credit display 906 decreases by one credit, while the number of credits shown in the bet display 912 increases by one credit.

A player may "cash out" by pressing a cash out button 918. When a player cashes out, the wagering game machine 900 dispenses a voucher or currency corresponding to the number of remaining credits. The wagering game machine 900 may employ other payout mechanisms such as credit slips (which are redeemable by a cashier) or electronically recordable cards (which track player credits), or electronic funds transfer.

The wagering game machine also includes a primary display unit 904 and a secondary display unit 910 (also known as a "top box"). The wagering game machine may also include an auxiliary video display 930. In one embodiment, the primary display unit 904 displays a plurality of video reels 920. According to embodiments of the invention, the display units 904 and 910 can include any visual representation or exhibition, including moving physical objects (e.g., mechanical reels and wheels), dynamic lighting, and video images. In one embodiment, each reel 920 includes a plurality of symbols such as bells, hearts, fruits, numbers, letters, bars or other images, which correspond to a theme associated with the wagering game machine 900. Furthermore, as shown in FIG, 9, the wagering game machine 900 includes a audio presentation unit 928. The audio presentation unit 928 can include audio speakers or other suitable sound projection devices.

In one embodiment, a plurality of wagering game machines can be connected together with other gaming systems to form a gaming network. In one embodiment, the wagering game machine described above can receive wagering game content from a wagering game content filter, as described herein.

General

In this description, numerous specific details are set forth. However, it is understood that embodiments of the invention may be practiced without these specific details. In other instances, well-known circuits, structures and techniques have not been shown in detail in order not to obscure the understanding of this description. Note that in this description, references to "one embodiment" or "an embodiment" mean that the feature being referred to is included in at least one embodiment of the invention. Further, separate references to "one embodiment" in this description do not necessarily refer to the same embodiment; however, neither are such embodiments mutually exclusive, unless so stated and except as will be readily apparent to those of ordinary skill in the art. Thus, the present invention can include any variety of combinations and/or integrations of the embodiments described herein. Each claim, as may be amended, constitutes an embodiment of the invention, incorporated by reference into the detailed description.

Herein, block diagrams illustrate example embodiments of the invention. Also herein, flow diagrams illustrate operations of the example embodiments of the invention. The operations of the flow diagrams are described with reference to the example embodiments shown in the block diagrams. However, it should be understood that the operations of the flow diagrams could be performed by embodiments of the invention other than those discussed with reference to the block diagrams, and embodiments discussed with references to the block diagrams could perform operations different than those discussed with reference to the flow diagrams. Additionally, some embodiments may not perform all the operations shown in a flow diagram. Moreover, it should be understood that although the flow diagrams depict serial operations, certain embodiments could perform certain of those operations in parallel.

The invention claimed is:

1. A wagering game system comprising:

a memory unit;

a wagering game content filter to receive wagering game content over a communications network, to authenticate the wagering game content, and to filter authenticated wagering game content from non-authenticated wagering game content to provide filtered wagering game content;

a filter authentication unit to authenticate the wagering game content filter, upon authenticating the wagering game content filter, receive the filtered wagering game content, and forward the filtered wagering game content to the memory unit; and a processor to fetch the filtered, authenticated wagering game content from the memory unit and to conduct a wagering game using the authenticated wagering game content, wherein the wagering game content filter is to authenticate the filter authentication unit before providing the filtered wagering game content to the filter authentication unit, and wherein the filter authentication unit and the wagering game content filter authenticate each other using a three-way handshake.

2. The wagering game system of claim 1, wherein the wagering game content filter, memory unit, and processor are contained within a cabinet.

3. The wagering game system of claim 1, wherein the filter authentication unit establishes a trust relationship with the wagering game content filter, wherein the memory unit and processor are contained within a cabinet, and wherein the wagering game content filter is disposed outside the cabinet.

4. The wagering game system of claim 1, wherein the filter authentication unit establishes a trust relationship with the wagering game content filter, wherein the memory unit, processor, and wagering game content filter are contained within a cabinet.

5. The wagering game system of claim 1, wherein the wagering game content filter authenticates the wagering game content using message authentication codes, digital signatures, or private key encryption.

6. The wagering game system of claim 1, wherein the wagering game is selected from the group consisting of slots, video poker, video black jack, video roulette, and keno.

7. The wagering game system of claim 1, wherein the wagering game content is selected from the group consisting of audio content, video content, and computer program code.

8. The system of claim 1, wherein the wagering game content filter includes a storage unit to store the wagering game content, the wagering game content filter deleting the non-authenticated content from the storage unit.

9. The system of claim 1, further including a wagering game content server from which the wagering game content filter receives the wagering game content over the communications network.

10. The system of claim 1, further including a persistent storage unit, and wherein the wagering game content filter forwards the authenticated wagering game content to the persistent storage unit.

11. The system of claim 1, wherein the three-way handshake comprises:

transmitting a challenge message from the wagering game content filter to the filter authentication unit;

receiving a digitally signed version of the challenge message from the filter authentication unit;

authenticating the digitally signed version of the challenge message; and upon authenticating the digitally signed version of the challenge message, indicating to the filter authentication unit that the digitally signed version has been authenticated.

12. The system of claim 1, wherein the filter authentication unit is disposed within a cabinet and the wagering game content filter is disposed outside the cabinet, and wherein the wagering game content filter is to provide filtered wagering game content to a plurality of wagering game machines in the wagering game system, wherein each of the wagering game machines comprise an associated filter authentication unit to authenticate the wagering game content filter and be authenticated by the wagering game content filter prior to providing filtered wagering game content.

13. A non-transitory machine readable medium including instructions, which when executed by a machine, cause the machine to perform operations comprising:

receiving wagering game content over a communications network;

determining, at a wagering game content filter, whether the wagering game content originated from a trusted source and whether the wagering game content has been modified;

authenticating a filter authentication unit using the wagering game content filter, the filter authentication unit being coupled to a wagering game machine, wherein authenticating the filter authentication unit is performed using a three-way handshake between the wagering game content filter and the filter authentication unit;

upon authenticating the filter authentication unit, transmitting wagering game content to the wagering game machine.

14. The non-transitory machine readable medium of claim 13 to cause the machine to further perform operations comprising:

if the wagering game content did not originate from a trusted source or if the wagering game content has been modified, prohibiting transmission of the wagering game content to the memory unit.

15. The non-transitory machine readable medium of claim 13 to cause the machine to further perform operations comprising:

encrypting the wagering game content in a format that can be unencrypted by the wagering game machine.

16. The non-transitory machine readable medium of claim 13, wherein the wagering game content is selected from the group consisting of audio content, video content, and computer program code.

17. The non-transitory machine readable medium of claim 13, wherein the machine-readable medium is disposed within a cabinet of the wagering game machine.

18. The non-transitory machine readable medium of claim 13, wherein the machine-readable medium is disposed outside a cabinet of the wagering game machine.

19. A method comprising:

authenticating a wagering game content filter using a filter authentication unit;

upon authenticating the wagering game content filter:

receiving, in a wagering game machine, wagering game content forwarded from the wagering game content filter, wherein the wagering game content is received over a network;

authenticating the filter authentication unit before forwarding the wagering game content, wherein the filter authentication unit and the wagering game content filter authenticate each other using a three-way handshake; and forwarding the wagering game content after determining that the wagering game content originated from a trusted source and was not modified; and conducting a wagering game using the wagering game content.

20. The method of claim 19, wherein the wagering game content includes audio content, video content, or computer program code.

21. The method of claim 19, wherein the wagering game content is received in a memory unit.

22. The method of claim 21, wherein the memory unit and the gaming content filter are contained within a cabinet.

23. The method of claim 21, wherein the memory unit is contained within a cabinet and the gaming content filter is disposed outside the cabinet.

24. The method of claim 21 further comprising:

decrypting the wagering game content.

25. A system comprising:

a plurality of wagering game machines; and a wagering game content filter communicatively coupled to the plurality of wagering game machines, and configured to:

authenticate wagering game content received over a communication network; and upon authentication of the wagering game content, transmit authenticated wagering game content to at least one of a plurality of remote wagering game machines;

wherein each particular wagering game machine of the plurality of wagering game machines is configured to:

authenticate the wagering game content filter; and upon authenticating the wagering game content filter:

store the authenticated wagering game content in a memory of the particular wagering game machine; and conduct a wagering game using the authenticated wagering game content.

26. The system of claim 25, wherein the wagering game content filter authenticates wagering game content by verifying that the content has been approved by a gaming regulator.

27. The system of claim 25, wherein the wagering game content filter transmits authenticated wagering game content to those of the plurality of wagering game machines that have established a trust relationship with the wagering game content filter.

28. A method comprising:

authenticating, at a wagering game content filter that is communicatively coupled to a plurality of wagering game machines, wagering game content received over a communication network; and upon authentication of the wagering game content, transmit authenticated wagering game content to at least one of a plurality of remote wagering game machines, wherein the at least one of the plurality of remote wagering game machines authenticates the wagering game content filter and upon authenticating the wagering game content filter:

stores the authenticated wagering game content in a memory of the particular wagering game machine; and conducts a wagering game using the authenticated wagering game content.

29. The method of claim 28, wherein authenticating wagering game content comprises authenticating wagering game content by verifying that the content has been approved by a gaming regulator.

30. The method of claim 28, further comprising transmitting authenticated wagering game content from the wagering game content filter to those of the plurality of wagering game machines that have established a trust relationship with the wagering game content filter.

31. A non-transitory machine readable medium including instructions, which when executed by a machine, cause the machine to perform operations comprising:

authenticating, at a wagering game content filter that is communicatively coupled to a plurality of wagering game machines, wagering game content received over a communication network; and upon authentication of the wagering game content, transmit authenticated wagering game content to at least one of a plurality of remote wagering game machines, wherein the at least one of the plurality of remote wagering game machines authenticates the wagering game content filter and upon authenticating the wagering game content filter:

stores the authenticated wagering game content in a memory of the particular wagering game machine; and conducts a wagering game using the authenticated wagering game content.

32. The non-transitory machine readable medium of claim 31, wherein the instructions to authenticate the wagering game content comprises instructions, which when executed by the machine, cause the machine to authenticate wagering game content by verifying that the content has been approved by a gaming regulator.

33. The non-transitory machine readable medium of claim 31, further comprising instructions, which when executed by the machine, cause the machine to perform operations comprising transmitting authenticated wagering game content from the wagering game content filter to those of the plurality of wagering game machines that have established a trust relationship with the wagering game content filter.

* * * * *

UNITED STATES PATENT AND TRADEMARK OFFICE

CERTIFICATE OF CORRECTION

PATENT NO. : 8,038,530 B2
APPLICATION NO. : 11/276187
DATED : October 18, 2011
INVENTOR(S) : Kenneth A. Aird et al.

It is certified that error appears in the above-identified patent and that said Letters Patent is hereby corrected as shown below:

In column 2, line 14, delete “FIG,” and insert -- FIG. --, therefor.

In column 2, line 17, delete “FIG,” and insert -- FIG. --, therefor.

In column 2, line 20, delete “FIG,” and insert -- FIG. --, therefor.

In column 2, line 23, delete “FIG,” and insert -- FIG. --, therefor.

In column 2, line 26, delete “FIG,” and insert -- FIG. --, therefor.

In column 2, line 29, delete “FIG,” and insert -- FIG. --, therefor.

In column 2, line 32, delete “FIG,” and insert -- FIG. --, therefor.

In column 2, line 36, delete “FIG,” and insert -- FIG. --, therefor.

In column 2, line 40, delete “FIG,” and insert -- FIG. --, therefor.

In column 2, line 60, delete “FIG,” and insert -- FIG. --, therefor.

In column 2, line 63, delete “FIG,” and insert -- FIG. --, therefor.

In column 3, line 4, delete “FIG,” and insert -- FIG. --, therefor.

In column 3, line 30, delete “FIG,” and insert -- FIG. --, therefor.

In column 3, line 32, delete “FIG,” and insert -- FIG. --, therefor.

In column 4, line 13, delete “FIG,” and insert -- FIG. --, therefor.

In column 4, line 33, delete “FIG,” and insert -- FIG. --, therefor.

In column 4, line 35, delete “FIG,” and insert -- FIG. --, therefor.

Signed and Sealed this
Seventh Day of February, 2012

David J. Kappos

David J. Kappos
*Director of the United States Patent and Trademark Office*

In column 4, line 37, delete “FIG,” and insert -- FIG. --, therefor.

In column 4, line 38, delete “FIG,” and insert -- FIG. --, therefor.

In column 4, line 53, delete “FIG,” and insert -- FIG. --, therefor.

In column 4, line 54, delete “described” and insert -- describe --, therefor.

In column 5, line 8, delete “FIG,” and insert -- FIG. --, therefor.

In column 5, line 10, delete “FIG,” and insert -- FIG. --, therefor.

In column 5, line 16, delete “FIG,” and insert -- FIG. --, therefor.

In column 5, line 29, delete “FIG,” and insert -- FIG. --, therefor.

In column 5, line 50, delete “FIG,” and insert -- FIG. --, therefor.

In column 5, line 51, delete “FIG,” and insert -- FIG. --, therefor.

In column 6, line 36, delete “FIG,” and insert -- FIG. --, therefor.

In column 6, line 37, delete “FIG,” and insert -- FIG. --, therefor.

In column 6, line 40, delete “FIG,” and insert -- FIG. --, therefor.

In column 6, line 60, delete “FIG,” and insert -- FIG. --, therefor.

In column 7, line 5, delete “FIG,” and insert -- FIG. --, therefor.

In column 7, line 6, delete “FIG,” and insert -- FIG. --, therefor.

In column 7, line 14, delete “FIG,” and insert -- FIG. --, therefor.

In column 7, line 46, delete “FIG,” and insert -- FIG. --, therefor.

In column 7, line 51, delete “FIG,” and insert -- FIG. --, therefor.

In column 7, line 54, delete “216 The” and insert -- 216. The --, therefor.

In column 7, line 64, delete “FIG,” and insert -- FIG. --, therefor.

In column 7, line 65, delete “FIG,” and insert -- FIG. --, therefor.

In column 8, line 9, delete “FIG,” and insert -- FIG. --, therefor.

In column 8, line 11, delete “FIG,” and insert -- FIG. --, therefor.

In column 8, line 27, delete “FIG,” and insert -- FIG. --, therefor.

In column 8, line 43, delete “FIG,” and insert -- FIG. --, therefor.

In column 9, line 4, delete “FIG,” and insert -- FIG. --, therefor.